US005540157A

United States Patent [19]

Andersson et al.

[11] Patent Number: 5,540,157

[45] Date of Patent: Jul. 30, 1996

[54] SINGLE-AXLE BOGIE FOR TRACKBOUND VEHICLE

[75] Inventors: Evert Andersson, Västerås; Mikael Wrang, Älta, both of Sweden

[73] Assignee: Asea Brown Boveri AB, Västerås, Sweden

[21] Appl. No.: 403,764

[22] PCT Filed: Sep. 23, 1993

[86] PCT No.: PCT/SE93/00766

§ 371 Date: Mar. 23, 1995

§ 102(e) Date: Mar. 23, 1995

[87] PCT Pub. No.: WO94/07728

PCT Pub. Date: Apr. 14, 1994

[30] Foreign Application Priority Data

Sep. 25, 1992 [SE] Sweden ..... 9202770

[51] Int. Cl.[6] ..... B61F 5/00

[52] U.S. Cl. ..... 105/167; 105/165; 295/34

[58] Field of Search ..... 105/165, 167, 105/168, 199.1; 295/1, 36.1, 34, 33

[56] References Cited

U.S. PATENT DOCUMENTS

| | | | |
|---|---|---|---|
| 452,134 | 5/1891 | Hunt | 105/165 |
| 922,844 | 5/1909 | Booser | 295/34 |
| 1,423,895 | 7/1922 | Woodward . | |
| 1,482,190 | 1/1924 | Hohenstein . | |
| 1,783,705 | 12/1930 | Emerson et al. | 295/34 |
| 2,915,020 | 12/1959 | Bleibtreu | 105/168 |
| 3,687,085 | 8/1972 | Newman et al. | 105/167 |
| 3,690,271 | 9/1972 | Hobbs | 105/167 |
| 4,067,261 | 1/1978 | Scheffel . | |
| 4,294,482 | 10/1981 | Scheffel et al. | 295/34 |
| 5,031,545 | 7/1991 | Bourgeot | 105/199.1 |

FOREIGN PATENT DOCUMENTS

| | | | |
|---|---|---|---|
| 0295462 | 8/1991 | European Pat. Off. . | |
| 1240915 | 9/1960 | Germany | 105/168 |
| 115815 | 9/1979 | Japan | 105/165 |
| 8802712 | 4/1988 | WIPO | 105/165 |

*Primary Examiner*—Mark T. Le

*Attorney, Agent, or Firm*—Watson Cole Stevens Davis, P.L.L.C.

[57] ABSTRACT

The invention relates to a self-steering single-axle bogie for trackbound vehicles comprising one single wheel set (8) and wherein each wheel (8*a*, 8*b*) is rigidly connected to an intermediate wheel axle (14), wherein the wheel set (8) is attached rigidly or by means of springs (10) to a bogie frame (2), which is rotatably arranged around a vertical axis. Further, the bogie is joined to the car body (4) of the vehicle via at least one toggle link (16) extending in the longitudinal direction of the vehicle and preventing the bogie from tilting, or nodding, in the vertical longitudinal plane through the vehicle. The wheels (8*a*, 8*b*) exhibit conical or saddle-shaped treads (18), with an elevated conicity at least in the tread (18) nearest the wheel flange, the wheel set (8) being guided into approximate radial alignment in the track through the combined effect of the conicity of the wheels (8*a*, 8*b*) in the tread (18) and the frictional forces which act between wheels (8*a*, 8*b*) and rails (20*a*, 20*b*).

10 Claims, 3 Drawing Sheets

SINGLE-AXLE BOGIE FOR TRACKBOUND VEHICLE

TECHNICAL FIELD

The present invention relates to a single-axle bogie for a trackbound vehicle; wherein a wheel set rigidly interconnected by means of an intermediate axle is mounted in a bogie frame which is rotatable around the vertical axis of the frame and wherein the whole bogie is self-steering when negotiating a curve.

BACKGROUND ART

The current technique of providing long, trackbound vehicles with wheel arrangements is generally based on utilizing bogies, that is, rotatable, load-carrying frame structures which comprise two or more wheel sets, wheel axles and wheel suspension and wherein at least two bogies support a car body, the concept car body in this context being defined as the device which is intended to contain and/or constitute the base for the useful load (or payload). A variety of solutions for steering such bogies through track curves, and devices for minimizing oscillating movements during running, have been described over the years and at present constitute examples of well-tried technique. Of necessity, however, this type of bogie is heavy.

The reason for using bogies is also explained by the fact that the frame in the bogie permits two suspension levels between track and car body as well as improved possibilities of suspension of brake and drive equipment.

There is a desire to make the vehicles simpler and lighter, both in view of purchase and maintenance costs and in view of energy consumption when starting and stopping the vehicles. This also gives rise to a desire to reduce the weight of the bogies. One way of achieving bogies with lower weight is to use single-axle bogies. The wheel axle in a single-axle frame must be given the possibility of steering through track curves, while at the same time it is desired to counteract tendencies towards oscillation and winding of the bogie when driving at higher speeds.

In track curves the wheel axles in a trackbound vehicle should be aligned radially or almost radially to the track curve to make it possible to negotiate curves without friction arising and without significant wear of wheels and rails. Steering a wheel axle through a track curve means that the wheel axle is aligned radially to the track curve, but may just as well be expressed in such a way that the wheels are aligned and roll in the direction of a tangent of the rails, or almost along with the direction of a tangent of the rails.

Within railway engineering, there has long been a desire to find a practicable model of a single-axle bogie. It is known to try to equip trackbound vehicles with single-axle bogies with a wheel set, where the wheel set is journalled in a bogie frame and this bogie frame is rotatable around the vertical axis. In German patent specification DE 37 18 254, C2, referred to here as Di, a proposal for such a single-axle bogie is described. This specification describes a two-wheel bogie, the wheels of which are journalled in a bogie frame which is attached to the car body of the vehicle for taking up tractive efforts and braking forces. Further, the direction of rolling of the wheels is determined by a guiding device. In addition, via resilient elements the wheels are movable vertically and in lateral direction in relation to the car body and tangentially alignable in relation to the direction of track. To make possible radial guiding of the bogie through a track curve, the bogie is adapted to be rotatable around the vertical axis. A guiding device which consists of, for example, guide rods extending from an adjacent bogie of the train transmits steering forces to the bogie wheels such that the wheels are aligned tangentially to the track direction in a track curve. In addition, the bogie frame is connected to the car body through at least one link arm which extends in the longitudinal direction of the vehicle and which allows the rotation of the bogie frame around the vertical axis, but which at the same time prevents the bogie from tilting over around the transverse axle of the bogie during braking and acceleration.

The tread of a railway wheel is usually slightly conically shaped. The wheel has a certain conicity. According to a well-known pattern, this means that a wheel set or a bogie rotatable around the vertical axis displays a tendency to describe a sinusoidal motion when travelling on straight track. This property contributes to reduce the critical speed when driving a trackbound vehicle. The guiding device according to patent specification D1, mentioned above, also has the task of counteracting the oscillating and winding tendencies of the single-axle bogie when travelling on straight track.

A considerable disadvantage of the solution that the introduction of a single-axle bogie described in patent specification D1 entails is the need of the long guide rods which transmit the steering forces to the bogie. These guide rods are clumsy and unwieldy, especially when extending from the front to the rear bogie in the same vehicle, where the guide rods may have a length of over 10 m. In addition, under certain conditions, incorrect steering forces are transmitted via these guide rods, for example when a vehicle enters and exits a track curve and when passing through points with two adjacent and consecutive curves in different directions, where the radial alignment of a wheel axle to the track direction is to be different from that which the guide rods of the guiding device tend to align. This may cause extra wear on wheels and rails and in critical situations an increased risk of derailment. In addition, the guide rods described can cause maintenance problems, such as the need for accurate alignment and problems with wear and play in the joints of the guide rods. Furthermore, the long guide rods may cause oscillations and vibrations in the vehicle.

From U.S. Pat. No. 4,067,261 it is known to design a bogie with self-steering, that is, that the wheels in the bogie are aligned tangentially to the rails in a track curve, by the treads of the wheels having elevated conicity and hence strive to align the bogie in the track direction. However, the device according to the this patent only relates to two- or multi-axle bogies or single wheel axles attached directly to a car body. This patent does not describe any solution regarding self-steering single-axle bogies or demonstrate any necessary auxiliary devices for achieving a well-functioning self-steering single-axle bogie.

The conicity of the tread of a railway wheel is a measure of the degree of increasing wheel radius measured in a radial section across the tread of the wheel in a direction towards the wheel flange. Usually, the concept effective conicity is used, since the wear on the tread of a wheel changes the original purely conical shape of the tread of the wheel, whereby the tread may assume a saddle shape. By effective conicity is then meant the ratio of the change of the radius of rolling of the wheel to the lateral movement of the wheel across the rail.

SUMMARY OF THE INVENTION

The invention relates to a self-steering single-axle bogie for trackbound vehicles which comprises one single wheel set and wherein each wheel is rigidly connected to an intermediate wheel axle, the wheel set being attached rigidly or by means of springs to a bogie frame which is rotatably arranged around a vertical axis. Further, the bogie is joined to the car body of the vehicle via at least one toggle link which extends in the longitudinal direction of the vehicle and which prevents the bogie from tilting, or nodding, in the vertical longitudinal plane through the vehicle. The wheels exhibit conical or saddle-shaped treads, with an elevated conicity at least in the tread nearest the wheel flange, the wheel set being guided to an approximately radial direction in the track through the combined effect of the conicity of the wheels in %he tread and the frictional forces which act between the wheels and the rail.

The bogie frame is attached, for example by means of springs, to the car body in the vehicle such that the bogie is allowed a certain movement also around the longitudinal axis of the vehicle as well as vertically and laterally in relation to the car body.

The attachment of the bogie frame to the car body is performed with such a rigidity that the forces on the wheels, which are generated by the self-steering ability, are at least as great as the yaw resistance (resistance to rotation in the horizontal plane) which is caused by the attachment means, for example by the resilience which occurs between the bogie and the car body. In this way, the bogie wheels are aligned in the tangential direction of the track curve when negotiating curves.

To avoid the above-mentioned problem occurring in bogies with a self-steering ability, of describing a periodic oscillating movement in the direction of travel at higher speeds on straight track, the bogie may be equipped with dampers, preferably arranged in the longitudinal direction of the vehicle, between the sides of the bogie frame and the car body. These dampers are designed with a speed-dependent characteristic, whereby the damper exhibits a high damping in relation to the high-frequency winding motions with a relatively low amplitude (1–2 mrad) of the bogie which may occur at a high speed and a lower resistance to the relatively low-frequency rotary motions which are caused by the vehicle, with the bogie used for the purpose, being about to enter or exit a curve.

The winding motions can be reduced further by introducing a rigidity to yawing between the car body and the bogie frame.

The toggle links which prevent the bogie from tilting in the longitudinal direction of the vehicle permit the rotations of the bogie when the bogie rotates in the horizontal plane, since the toggle links are articulately joined to the car body.

The object of the invention according to the description is to arrive at a very light bogie also for relatively fast trackbound vehicles. Furthermore, the intention is to achieve a bogie with simple technique and with properties which contribute to low wear of wheels and rails.

DESCRIPTION OF THE PREFERRED EMBODIMENTS

Figure 1:
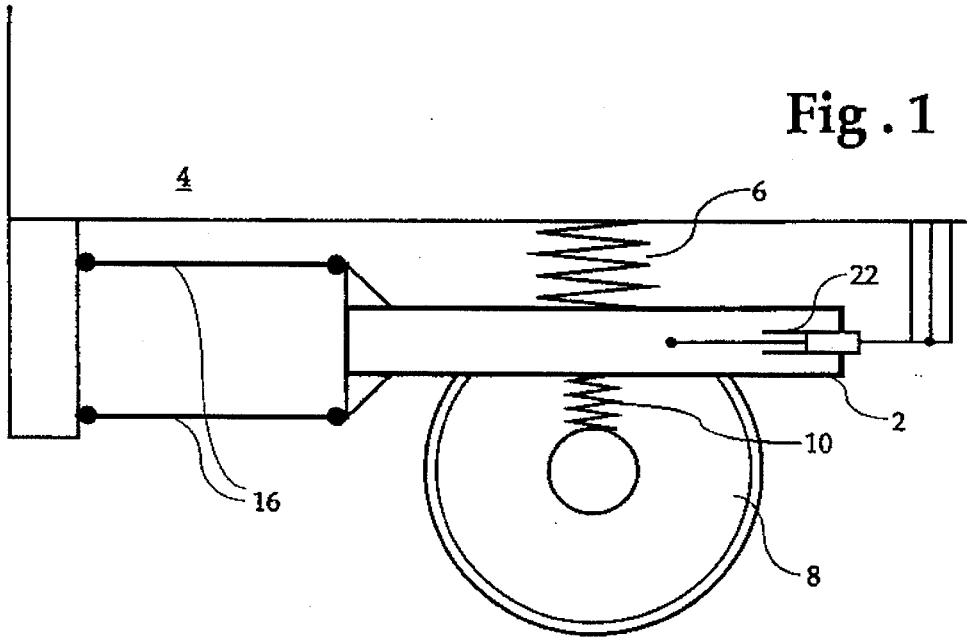
FIG. 1 schematically shows a side view of a single-axle bogie according to the invention.

A number of embodiments of the invention will be described with reference to the accompanying figures.

The figures illustrate a bogie frame 2 in a single-axle bogie which is attached to a car body 4. The attachment can be achieved by means of springs, secondary springs 6, but also other flexible connections can be utilized. The wheels 8*a*, 8*b* are rigidly interconnected via an intermediate wheel axle 14 and thus form a wheel set 8. The wheel set 8 is attached rigidly or by means of primary springs 10 to the bogie frame 2. The bogie frame 2 is rotatable about its vertical axis through its flexible attachment to the car body 4.

Figure 1B:
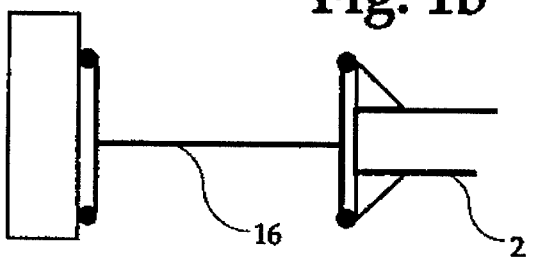
FIG. 1*b* shows a modified embodiment of a toggle link for the bogie.
Figure 3:
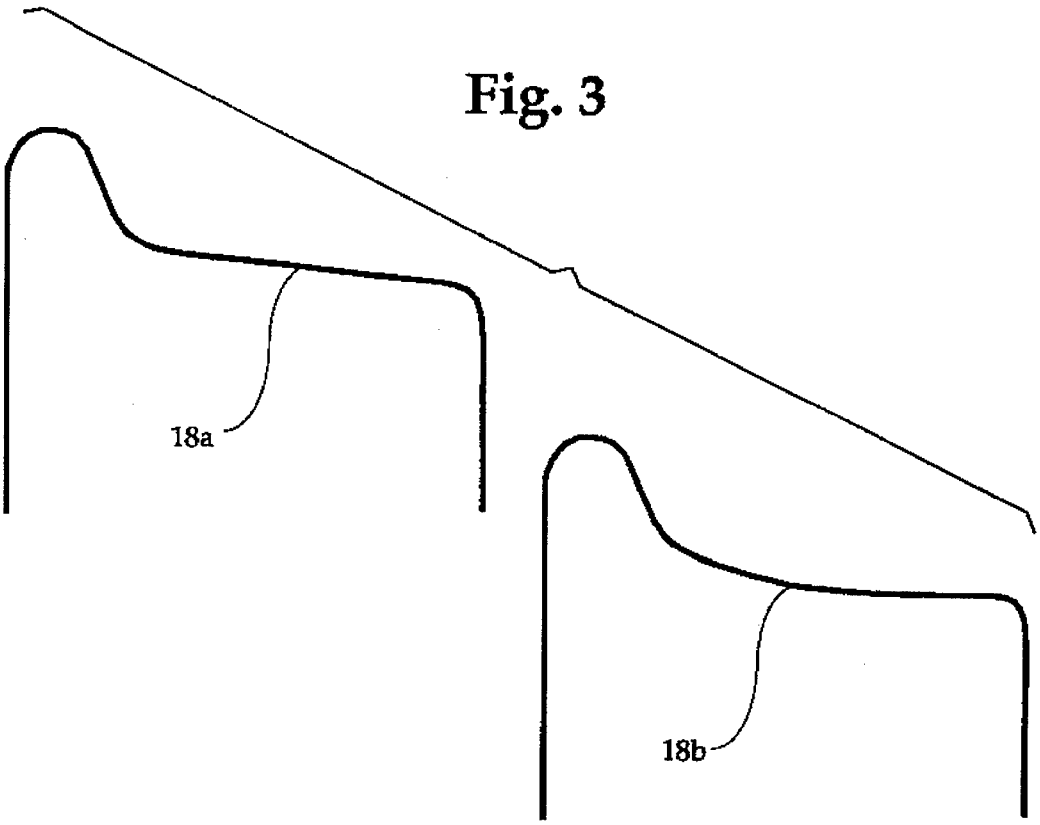
FIG. 3 illustrates different tread profiles with elevated conicity.

To prevent the bogie from tilting over in the vertical longitudinal plane of the vehicle, the bogie frame 2 is connected to the car body 4 of the vehicle via at least one toggle link 16 which in the normal case, when travelling on straight track, extends in the longitudinal direction of the vehicle. The toggle link 16 is articulately arranged at its connection to both the car body 4 and the bogie frame 2 in order for the toggle link 16 to permit the bogie frame 2 to rotate in the horizontal plane. Preferably, two parallel toggle links 16 are arranged in the same vertical plane, one of them suitably located higher than and the other lower than the bogie frame 2. FIG. 1*b* shows an alternative, in which toggle joint 16 is designed with one link arm only.

To bring about the described self-steering, the treads 18 of the wheels 8*a*, 8*i b* are made with elevated conicity. The self-steering is achieved in the single-axle bogie even at an effective conicity which is greater than 0.05, but preferably the effective conicity is $\geqq 0.2$. This elevated conicity is exhibited by wheels with treads 18 which may have a purely conical shape 18*a* or be saddle-shaped 18*b*, in which case the conicity increases nearer the wheel flange.

Figure 2:
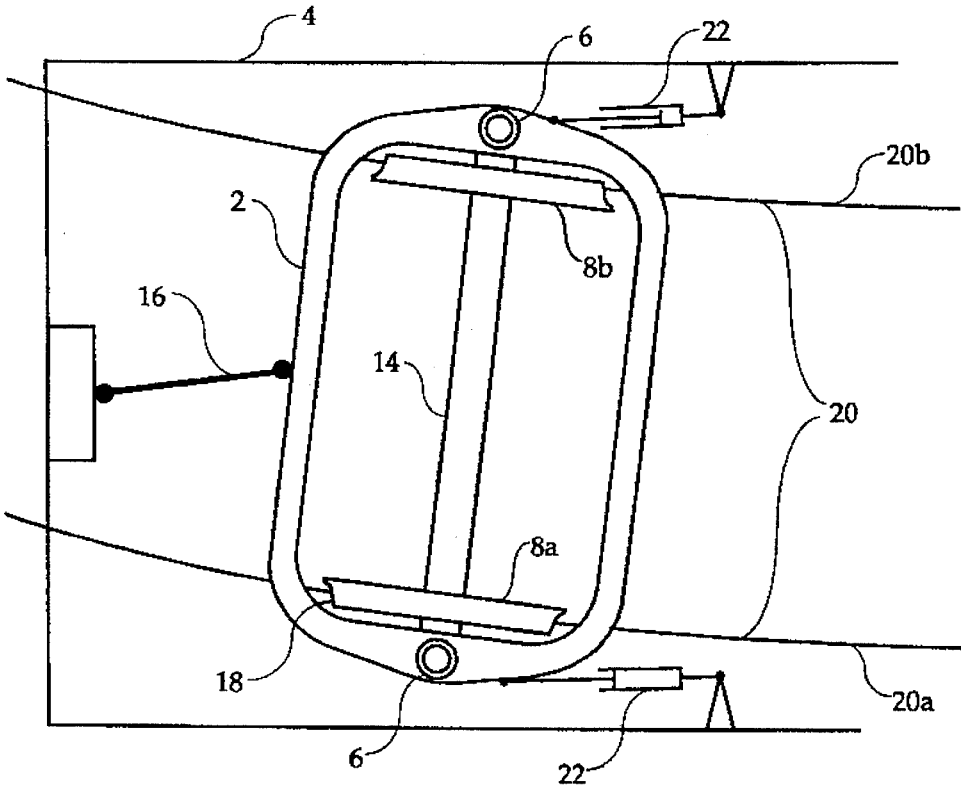
FIG. 2 schematically represents the same bogie in a view from above, the car body above the bogie being represented by its contours.

When an outer wheel 8*a* of the bogie travels into a track curve 20, the rail 20*a* and the wheel 8*a* contact each other in an orbital path on the tread 18 of the wheel 8*a* nearer the wheel flange than normally. A larger circumference is imparted to the orbital path of the wheel 8*a* because of the elevated conicity of the tread 18 of the wheel. In a corresponding way, a smaller orbital path than normal is imparted to the inner wheel 8*b*. This causes the wheel axle 14 and hence the bogie to become aligned approximately radially to the track. The steering effect is determined by the difference in the radius of orbital path between the outer wheel 8*a* and the inner wheel 8*b*. The steering caused by the wheels 8*a*, 8*b*, which aligns the bogie in the radial direction of the track curve 20, is illustrated in FIG. 2.

Figure 4A:
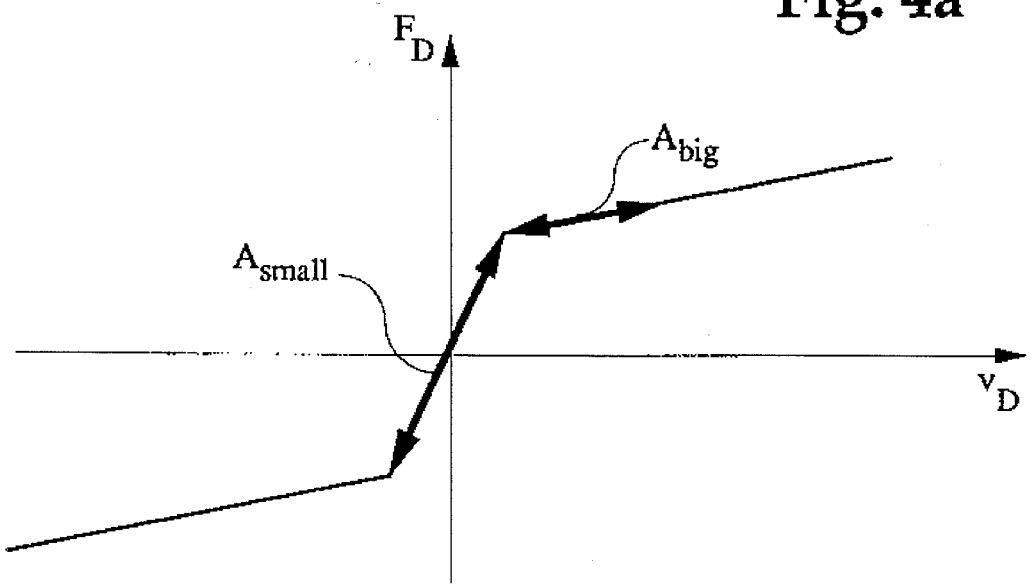
FIG. 4*a* shows by means of a diagram a speed-dependent characteristic for a damping means with which the bogie is provided.

To avoid the risk of winding movements when travelling on straight track, especially at high speeds, dampers 22 are arranged between the sides of the bogie frame 2 and the car body 4. These dampers 22 are suitably horizontally mounted, or mounted in some other way, with an effect such that the rotary motions of the bogie, which are of relatively high frequency, in the horizontal plane are damped. By motions of a high frequency are meant in this connection preferably rotary motions with a frequency exceeding about 2 Hz. In addition, the dampers 22 are provided with a damping characteristic which causes the bogie to perform, without any major resistance, the relatively large (>5 mrad) but low-frequency rotary motions which are typical when entering or exiting curves. FIG. 4*a* shows a characteristic of the damper function according to the guidelines described.

The damper force $F_D$ on the bogie transmitted by the dampers 22 is shown in the figure as a function of the speed $V_D$ of the damper (in the case of damping movements). The curve indicates the main operating range of the damper in case of small amplitudes by $A_{small}$ and the main operating range in case of large but low-frequency rotary motions (e.g. when the bogie enters a curve) by $A_{big}$. The damping is here defined as the quotient between damping force and the speed of the damper.

The flexible attachment of the bogie to the car body 4, arranged, for example, by means of secondary springs 6, is given a certain rigidity in relation to the rotation of the bogie in the horizontal plane. This rigidity also contributes to counteract the tendency to winding motions. Still the rigidity is such that the forces emanating from the rigidity of the attachment device, which tend to counteract a rotation of the bogie in the horizontal plane are not greater than the steering forces which in a track curve 20, because of the effective conicity of the treads 18 of the wheels 8*a*, 8*b*, force the bogie to rotate in the horizontal plane. The forces or moments of forces arising from the attachment and acting against the steering action must not be greater than the steering forces from the wheel set 8 in all track curves, down to a smallest radius which normally occurs in railway operation (c. 200 m).

For a vehicle with a car body and two bogies rotatable therebelow, the angle of rotation (v) in the horizontal plane, between each bogie and the car body, is approximately equal to v=A/R, where A is half the distance in the longitudinal direction between the centres of rotation of the two bogies and R is the radius of the track curve.

The steering forces, $F_x$, on a bogie, caused by the conicity of the wheels, can amount to a maximum value of $F_x=f_x \cdot Q_0$ on each wheel, where $f_x$ is the frictional coefficient between wheel and rail, obtainable in the longitudinal direction, and $Q_0$ is the vertical load on each wheel.

As an example may be mentioned that, on the leading wheel set, the steering forces are directed forwards on the outer-curve wheels and directed backwards on the inner-curve wheels. The couple of forces thus arising on this wheel set gives a torque $M=F_x \cdot B=f_x \cdot Q_0 \cdot B$, where B is the lateral distance between the contact points of the wheels with the respective rail.

The requirement for self-steering in a given curve radius R is that the counteracting torque in the horizontal plane from the attachment between the car body and the bogie, at the angle of rotation v=A/R occurring, is not greater than the possible steering torque $M=f_x \cdot Q_0 \cdot B$.

If, for example, $f_x=0.25$ $Q_0=60$ kN

B=1.5 m then M=22.5 kN, which value the moment of force at the attachment at the angle v=A/R must not exceed in order to obtain self-steering. With, for example, A=5 m and $R_{min}$200 m, the angle v becomes v=2.5 mrad.

Figure 4B:
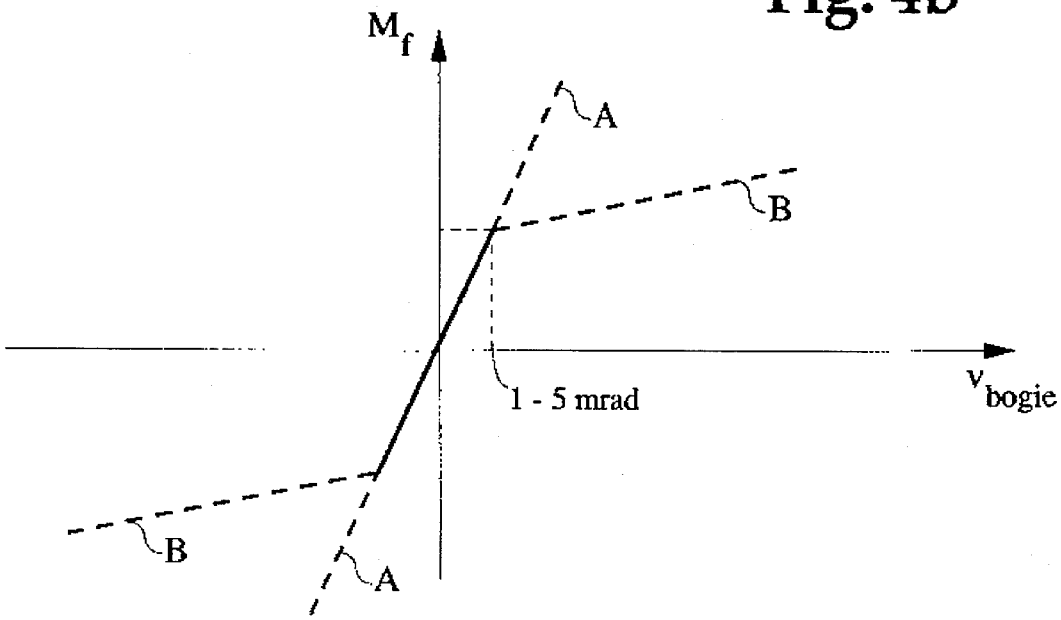
FIG. 4*b* shows a stiffness characteristic for the resilient attachment—associated with the bogie—to the car body of the vehicle.

The rigidity to rotary motions in the horizontal plane for a bogie according to the invention is shown in FIG. 4*b*, where the rigidity (defined as the quotient between torque and angle of rotation) at the flexible attachment between the car body and the bogie may be obtained from the curve which, according to the figure, indicates the torque $M_f$ in the horizontal plane as a function of the angle of rotation $v_{bogie}$ in the horizontal plane between the bogie and the car body. If the rigidity to small angles of rotation is high (alt. A), the rigidity to large angles (>5 mrad) may need to be made lower (alt. B), so that the yaw resistance (the torque against yawing) does not risk becoming higher than the torque from the steering forces on the wheels (at normally occurring curves and normal friction between wheels and rails). The breakpoint for the curve according to alternative B may then be located at an angle of rotation which amounts to, for example, 1–5 mrad.

We claim:

1. A single-axle, self-steering bogie for use with a car body of a trackbound vehicle, said bogie comprising;

a bogie frame, a wheel set comprising two spaced-apart wheels connected to an axle, said wheels being movable along rails of a track, first connection means for connecting said wheel set to said bogie frame such that said wheel set is positioned in said bogie frame, second connection means for flexibly connecting said bogie frame to said car body such that said bogie frame is positioned beneath said car body, said second connection means exhibiting a yaw resistance relative to said car body, and third connection means comprising a toggle link for connecting said bogie frame to said car body, said toggle link extending in a longitudinal direction of said car body and enabling said bogie frame to rotate about a vertical axis yet prevent tilting thereof in a vertical longitudinal plane of the car body, said wheels of said wheel set defining treads of sufficient effective conicity that when rolling on a curved track, steering forces generated thereby are at least as great as said yaw resistance of said second connection means to enable said bogie to radially align with a radius of the track curve.

2. A bogie according to claim 1, wherein said third connection means comprises the first and second toggle links positioned in parallel, said first toggle link being positioned above the second toggle link in a vertical plane, and attachment means for articulately attaching said first and second toggle links to said bogie frame.

3. A bogie according to claim 1, including speed-dependent damping means for connecting said bogie frame to said car body to dampen rotary movements of said bogie frame in a horizontal plane.

4. A bogie according to claim 3, wherein said damping means consists of piston/cylinder dampers.

5. A bogie according to claim 3, wherein said damping means are constructed to provide a higher damping of rotary movements in a horizontal plane having a low amplitude and a frequency about 2 Hz than rotary movements having a large amplitude and a frequency below 2 Hz.

6. A bogie according to claim 5, wherein said damping means comprise hydraulic dampers.

7. A bogie according to claim 5, wherein said damping means comprise friction dampers.

8. A bogie according to claim 1, wherein said second connection means is flexible.

9. A bogie according to claim 8, wherein said second connection means comprises a first spring.

10. A bogie according to claim 9, wherein said second connection means includes a second spring, said first and second springs respectively connected to opposite lateral sides of said bogie frame, said first and second springs providing a resistance to rotary movements which is greater for angles of rotation less than 5 mrad than for angles of rotation greater than 5 mrad.

* * * * *